United States Patent [19]

Nieuwendijk et al.

[11] Patent Number: 4,555,797

[45] Date of Patent: Nov. 26, 1985

[54] HYBRID LOUDSPEAKER SYSTEM FOR CONVERTING DIGITAL SIGNALS TO ACOUSTIC SIGNALS

[75] Inventors: Joris A. M. Nieuwendijk; Wilhelmus D. A. M. van Gijsel; Georgius B. J. Sanders; Jacob M. van Nieuwland, all of Eindhoven, Netherlands

[73] Assignee: U.S. Philips Corporation, New York, N.Y.

[21] Appl. No.: 648,428

[22] Filed: Sep. 7, 1984

[30] Foreign Application Priority Data

Sep. 15, 1983 [NL] Netherlands ..... 8303185

[51] Int. Cl.[4] ..... H04R 3/08; H04R 9/06

[52] U.S. Cl. ..... 381/117; 179/115.5 VC; 329/193; 381/96; 381/121

[58] Field of Search ..... 381/117, 111, 120, 121, 381/96; 179/115.5 PV, 115.5 VC, 115.5 R; 329/193; 455/614; 370/110.3

[56] References Cited

U.S. PATENT DOCUMENTS

| | | | |
|---|---|---|---|
| 3,651,266 | 3/1972 | Queen | 381/120 |
| 3,889,060 | 6/1975 | Goto et al. | 381/96 |
| 4,360,707 | 11/1982 | Joseph et al. | 381/117 |

FOREIGN PATENT DOCUMENTS

| | | | |
|---|---|---|---|
| 57-186898 | 11/1982 | Japan | 381/117 |
| 58-31699 | 2/1983 | Japan | 179/115.5 VC |
| 59-11098 | 1/1984 | Japan | 179/115.5 VC |

*Primary Examiner*—Gene Z. Rubinson
*Assistant Examiner*—Danita R. Byrd
*Attorney, Agent, or Firm*—Thomas A. Briody; William J. Streeter

[57] ABSTRACT

In a loudspeaker system for converting an n-bit digitized electric signal (6) into an acoustic signal a plurality of sections (voice coils 14.1, 14.2, 14.3, 14.p) of a digital loudspeaker (1) are driven directly by the p most significant bits of the n-bit digitized electric signal (6). The loudspeaker (1) comprises at least one additional section (14.p+1). This $(p+1)^{th}$ voice coil receives a signal from a digital-to-analog converter (5), the input signal of the digital-to-analog converter comprising at least the n-p least significant bits (FIG. 2). In a different embodiment the digital-to-analog converter (5) receives all the n bits of the digitized electric signal as the input signal. At least the p sections (14.1 to 14.p) which correspond to the p most significant bits are provided with means (the resistances r) for producing a signal which is a measure of the sum of their instantaneous drive signals and for applying the said signal to a signal combination unit (32) arranged in the line (10) from the output of the digital-to-analog converter (5) to the $(p+1)^{th}$ section ($R_1$). By means of this correction circuit the distortion in the loudspeaker system can be reduced substantially (FIG. 3*b*).

8 Claims, 6 Drawing Figures

HYBRID LOUDSPEAKER SYSTEM FOR CONVERTING DIGITAL SIGNALS TO ACOUSTIC SIGNALS

The invention relates to a loudspeaker system for converting an n-bit digitized electric signal (n being an integer and >2) into an acoustic signal. Specifically, system comprises an electroacoustic transducer provided with a diaphragm and an electromechanical transducer device for converting an electric signal into a mechanical quantity for driving the diaphragm. The transducer device comprises p sections, means being provided for driving each of the p sections with a corresponding bit of at least the most significant p bits of the n-bit digitized electric signal. Such a loudspeaker system is known from the publication "The acoustic characteristics of moving-coil type PCM digital loudspeakers (I)" by K. Inanaga and M. Nishimura, from the Proceedings of the Spring Conference of the Acoustical Society of Japan, pages 649 and 650, May 1981.

The known loudspeaker system comprises an electroacoustic transducer in the form of a moving-coil loudspeaker, the electromechanical transducer device being constructed as a voice-coil device comprising a plurality of separate voice coils arranged on a voice-coil former which cooperates with a magnet system of the transducer. The electromechanical transducer device converts the electric signal applied to the voice coils into a mechanical quantity, namely into an excursion of the voice-coil former in a direction corresponding to the direction of the central axis of the voice-coil former. The excursion is transmitted to the diaphragm by the voice-coil former by the connection of said coil former with the diaphragm. The p sections therefore each comprise one voice coil.

The means for driving each of the p sections (voice coils) are so-constructed that the voice coils are driven with switched voltages whose magnitudes accord (increase) with the significance of the bits corresponding to the sections. The known loudspeaker system comprises as many sections as there are bits in the digitized electric signal. Hence, n=p.

In this respect it is to be noted that, although the prior-art loudspeaker system comprises an electroacoustic transducer in the form of a moving-coil loudspeaker, the invention is not limited to digital loudspeaker systems comprising a moving-coil loudspeaker. The invention is equally applicable to digital loudspeaker systems comprising an electrodynamic loudspeaker in the form of a ribbon-type loudspeaker, whose diaphragm comprises a single foil on which a plurality of voice coils are arranged or comprises a plurality of foils on each of which one or more voice coils are arranged in the form of a conductive layer. The invention is also applicable to digital loudspeaker systems comprising an electroacoustic transducer operating in accordance with a different principle, for example capacitive transducer or piezoelectric transducers. A digital piezoelectric transducer is known, for example, from German Offenlegungsschrift 23.28.999.

SUMMARY OF INVENTION

Digital loudspeaker systems known until now have the disadvantage that they exhibit a substantial distortion in the acoustic output signal. It is the object of the invention to enable the distortion component in the output signal of the loudspeaker system to be reduced.

To this end a loudspeaker system in accordance with the invention is characterized in that p is smaller than n and n-p>1. The loudspeaker system further comprises a digital to-analog converter and a $(p+1)^{th}$ section, the digital-to-analog converter having an input for receiving at least the n-p least significant bits of the n-bit digitized electric signal, and an output. The output of the digital-to-analog converter is coupled to the $(p+1)^{th}$ section to drive this section. The step in accordance with the invention is based on the recognition of the fact that the digital loudspeaker systems known until now are only capable of converting a digitized electric signal comprising a maximum of 8 to 9 bits into an acoustic signal. The division of the amplitude range into 8 to 9 bits is too coarse, resulting in a substantial distortion of the acoustic output signal. An improvement would be obtained if the electric signal were digitized into 15 or 16 bits and applied to an electro-acoustic transducer which is capable of converting this 15 to 16-bit digital signal directly into an acoustic signal. However, in practice such a transducer cannot be manufactured without very high production costs. Moreover, when a 15 or 16-bit digital signal is converted the values of the current on voltage settings for the most significant bit and the least significant bit will lie so far apart that unrealistically stringent requirements have to be imposed on the current or voltage setting for the most significant bit.

By converting a limited number of bits directly into an acoustic signal and applying the remaining bits to the transducer with a digital-to-analog converter a direct 15 or 16-bit conversion can be simulated, enabling a low distortion to be attained.

Moreover, a hybrid conversion has advantages over a conversion in which all bits are first converted into an analog signal in a digital-to-analog converter and are subsequently applied to a normal loudspeaker by an amplifier. The dissipation in this amplifier is very high because this (high-power) amplifier must be capable of handling the full analog signal. Hybrid conversion reduces the power dissipation because of the switched supply of the signals corresponding to the p most significant bits—which inherently results in a low power dissipation—and because the supply of the remaining bits is effected in an analog manner—at a substantially lower level—, so that the dissipation is also lower.

A loudspeaker system in accordance with the invention may be further characterized in that the digital-to-analog converter comprises an input for receiving the n-bit digitized electric signal, the output of the digital-to-analog converter is coupled to a first input of a signal combination unit having an output which is coupled to the $(p+1)^{th}$ section to drive this section, if necessary through an amplifier stage, means being provided for producing a signal which is a measure of the sum of the instantaneous drive signals of at least the p sections corresponding to the p most significant bits and for applying said signal to a second input of the signal combination unit. This can lead to a further reduction of the distortion in the acoustic output signal of the transducer system in that the system employs the principle of adding what is missing. All the n bits of the digitized electric signal are now applied to the digital-to-analog converter, so that the corresponding analog electric signal is available on the output of the analog-to-digital converter. An analog electric signal which is a measure of the analog-electric signal corresponding to the digital signal of the p most significant bits of the original digitized electric signal is supplied by the means for obtaining a signal. By applying this signal (which is consequently the sum of the instantaneous drive signals of at least the p sections corresponding to the p most significant bits) to a second input of the signal combination unit, an output signal is obtained on the output of this signal combination unit. This output signal provides a correction for the missing signal corresponding to the n-p least significant bits of the original digitized electric signal and which also provides a correction for distortion arising as a result of the nonexact current or voltage settings in the means for driving the p sections. An (analog) correction signal is applied to the $(p+1)^{th}$ section by the output of the signal combination unit, so that the distortion is reduced further. The distortion may be reduced even further if the loudspeaker system is also provided with means for producing a signal which is a measure of the sum, of the instantaneous drive signals of the p+1 sections corresponding to the p+1 most significant bits and for applying said signal to the second input of the signal combination unit. Applying the said signal corresponding to the $(p+1)^{th}$ section also to the signal combination unit results in negative feedback, so that it is also possible to compensate for time-dependent variations in said current or voltage settings. These variations are caused by for example, temperature variations.

As an alternative the output of the digital-to-analog converter may be coupled to a first input of a second signal combination unit having an output which is coupled to a $(p+2)^{th}$ section to drive this section, if necessary through a second amplifier stage. The means for producing a signal associated with the p sections may be adapted to supply the signal also to a second input of the second signal combination unit. The $(p+1)^{th}$ and $(p+2)^{th}$ sections may be further provided with means for producing a signal which is a measure of the sum of the instantaneous drive signals of at least the $(p+1)^{th}$ and $(p+2)^{th}$ sections and for applying said signal to the second input of the second signal combination unit. By the use of two correction circuits, namely a first circuit employing the "adding what is missing" principle supplies a correction signal to the $(p+1)^{th}$ section, and a second circuit which is a negative-feedback circuit which includes the $(p+2)^{th}$ section, the distortion can be further reduced. Moreover, less stringent requirements may have to be imposed on the amplifier stages in the loudspeaker system.

If the $(p+1)^{th}$ section is provided with means for producing a signal which is a measure of the sum of the instantaneous drive signals of the (p+1) sections corresponding to the p+1 most significant bits and for applying said signal to the second input of the signal combination unit, the output of the digital-to-analog converter may be coupled to a first input of a second signal combination unit having an output which is coupled to a $(p+2)^{th}$ section to drive this section, if required by a second amplifier stage. The means for producing a signal associated with the p+1 sections may be adapted to supply the signal also to a second input of the second signal combination unit, and the $(p+2)^{th}$ section may be provided with means for producing a signal which is a measure of the instantaneous drive signal of the $(p+2)^{th}$ section and for applying said signal to the second input of the second signal combination unit. Again two correction circuits are used. A first circuit is a negative-feedback circuit including the $(p+1)^{th}$ section and a second circuit is a negative-feedback circuit which includes the $(p+2)^{th}$ section.

Some embodiments of the invention will now be described in more detail, by way of example, with reference to the drawings, in which identical reference numerals in different Figures refer to the same elements.

DESCRIPTION OF THE PREFERRED EMBODIMENTS

Figure 1:
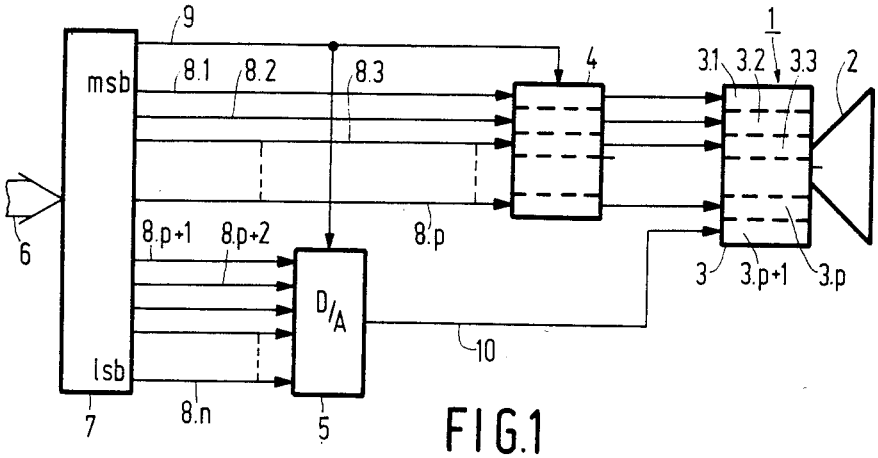
FIG. 1 shows a first loudspeaker system in accordance with the invention.

FIG. 1 shows a first embodiment of the invention schematically. The loudspeaker system comprises an electroacoustic transducer 1 equipped with a diaphragm 2 and a transfer device 3 for converting an electric signal into a mechanical quantity (i.e. an excursion) for driving the diaphragm 2. The transducer device comprises p+1 transducer sections 3.1, 3.2, 3.3, . . . 3.p, 3.p+1. The loudspeaker system further comprises means 4 for driving p of the sections 3.1 to 3.p inclusive and a digital-to-analog converter 5.

If necessary, the digitized electric signal 6 is converted in a converter 7, the output signal of the converter comprising n bits and one sign bit, n>2 and n-p>1. The p most significant bits are applied to the means 4 through the lines 8.1, 8.2, . . . 8.p. The bit applied through the line 8.1 is the most significant bit. Consecutive lines 8.2, . . . etc. with higher numbers carry less significant bits. The n-p least significant bits are applied to the digital-to-analog converter 5 via the lines 8.p+1, 8.p+2 . . . 8.n. The least significant bit is present on the line 8.n. through the line 9 the sign bit is applied both to the means 4 and to the digital-to-analog converter 5. The output of the digital-to-analog converter 5 is coupled to the $(p+1)^{th}$ section 3.p+1 by the line 10 to drive this section.

The operation of the loudspeaker system shown in FIG. 1 will be described in more detail with reference to FIG. 2. Although the invention relates to all types of digital loudspeaker systems (intended are loudspeaker systems using an arbitrary type of electro-acoustic transducer) the operation of the system shown in FIG. 2 will be described for a loudspeaker system comprising an electro-dynamic transducer. The transducer 1 is shown schematically in FIG. 2. For example, all the centring devices necessary for centring the diaphragm 2 and the voice-coil former 15 are not shown. Since these centring devices are not important for a further explanation, they been omitted for the sake of simplicity and clarity.

Figure 2:
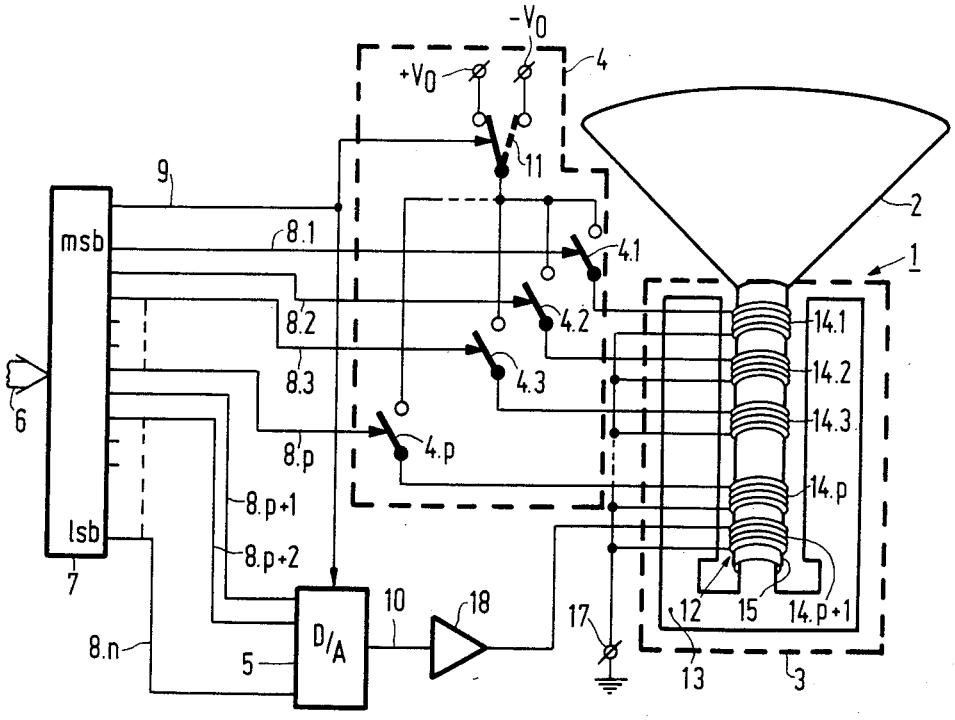
FIG. 2 shows the loudspeaker system of FIG. 1 in more detail.

The means 4 in FIG. 2 comprise a plurality of switches 4.1, 4.2, . . . 4.3, 4.p. The p most significant bits are applied to and control the switches 4.1 to 4.p through the lines 8.1 to 8.p in such a manner that if a bit of a high value (logic "one") is applied by a line, for example 8.1, to the associated switch, in this case the switch 4.1, this switch is closed and if a bit of a low value (logic "zero") is applied the switch is open. The means 4 further comprise a switch 11 which is controlled by the sign bit which is applied thereto by the line 9. If the sign bit is a logic "one" the switch 11 is in the position shown and if the sign bit is a logic "zero" the switch 11 is in the other position. In this way switching between the positive supply voltage $V_o$ and the negative supply voltage $-V_o$ is possible, depending on the sign bit.

The transducer device 3 is constructed as a voice-coil device 12, which cooperates with a magnet system 13. The voice-coil device comprises a plurality of separate voice coils 14.1, 14.2, 14.3, . . . 14.p, 14.p+1 arranged on a voice-coil former 15 of which one end is secured to the diaphragm 2 for imparting the mechanical quantity (the deflection of the voice-coil former) to the diaphragm 2.

One end of each respective voice coil 14.1 to 14.p is connected or not connected to the positive or the negative supply voltage by the switches 4.1 to 4.p. The other ends of the voice-coils 14.1 to 14.p and of the voice coil 14.p+1 are connected to a point 17 of constant potential (earth). Thus, the most significant bit ultimately drives the voice coil 14.1 by the switch 4.1. Consecutive less significant bits drive consecutive voice coils 14.2, 14.3, . . . etc. The output of the digital-to-analog converter 5 is coupled to the voice coil 14.p+1 through the line 10 and drives this voice coil.

The significance of the bits with respect to the drive of the voice coils 14.1 to 14.p, which coils all have an equal number of turns, manifests itself in the resistance values of the voice coils. For the voice coil 14.1 this resistance has a specific value, for example R, and for consecutive voice coils 14.2, . . . etc. the resistance increases each time by a factor of two. The currents through the voice coils (when the associated switches are closed) then decrease by successive factures of two from the voice coil 14.1 towards the voice coil 14.p in conformity with the significance of the bits. The resistance value of the voice coil 14.p+1 ($R_1$) must now be selected so that this voice coil is driven with the current amplitude. For this purpose an additional amplifier 18 may be arranged in the line 10.

Figure 3A:
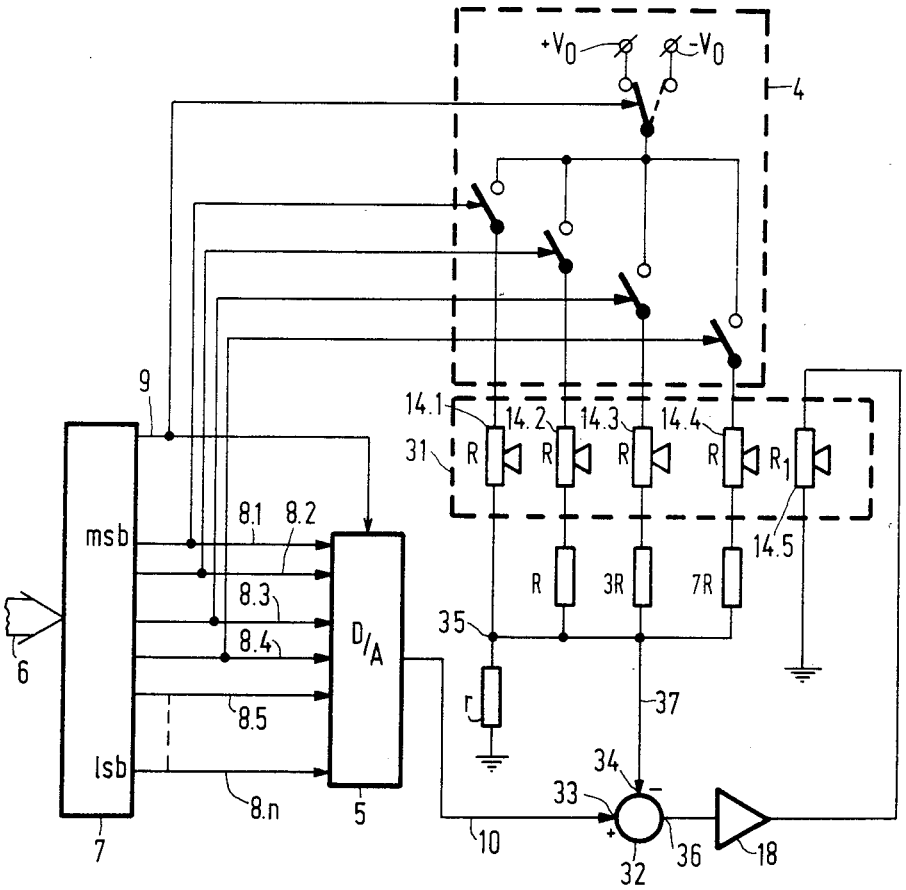
FIGS. 3*a* and 3*b* each show an embodiment equipped with a correction circuit, and FIGS. 4*a* and 4*b* each show an embodiment equipped with two correction circuits.

FIG. 3*a* shows a loudspeaker system which is based on the "adding-what-is-missing" principle. The digital electric signal 6, if necessary after conversion in the converter 7, comprises n bits which are all applied to the input of the digital-to-analog converter 5 by the lines 8.1, 8.2., 8.3, 8.4, 8.5, . . . 8.n and a sign bit which is applied to the digital to analog converter by the line 9. The -p, four most significant bits are also applied to the means 4 by the lines 8.1 to 8.4. The electroacoustic transducer, which again is an electrodynamic transducer, is shown schematically and is indicated by the reference numeral 31. Four of the five sections of the transducer 31 are represented schematically by the elements designated R. In fact, R represents the resistance value of each of the voice coils shown in FIG. 2. The resistance values of the voice coils are now selected to be equal to one another. In conformity with the significance of the bits which drive the voice coils by the lines 8.1 to 8.4 and the means 4, resistors of values R, 3R and 7R respectively are arranged in series with three of the four voice coils. A signal combination unit 32 is arranged in the line 10 from the output of the digital-to-analog converter 5 to the fifth voice coil $R_1$ of the transducer 31. The output signal of the digital-to-analog converter is applied to a first input 33 of the signal combination unit 32.

Figure 3B:
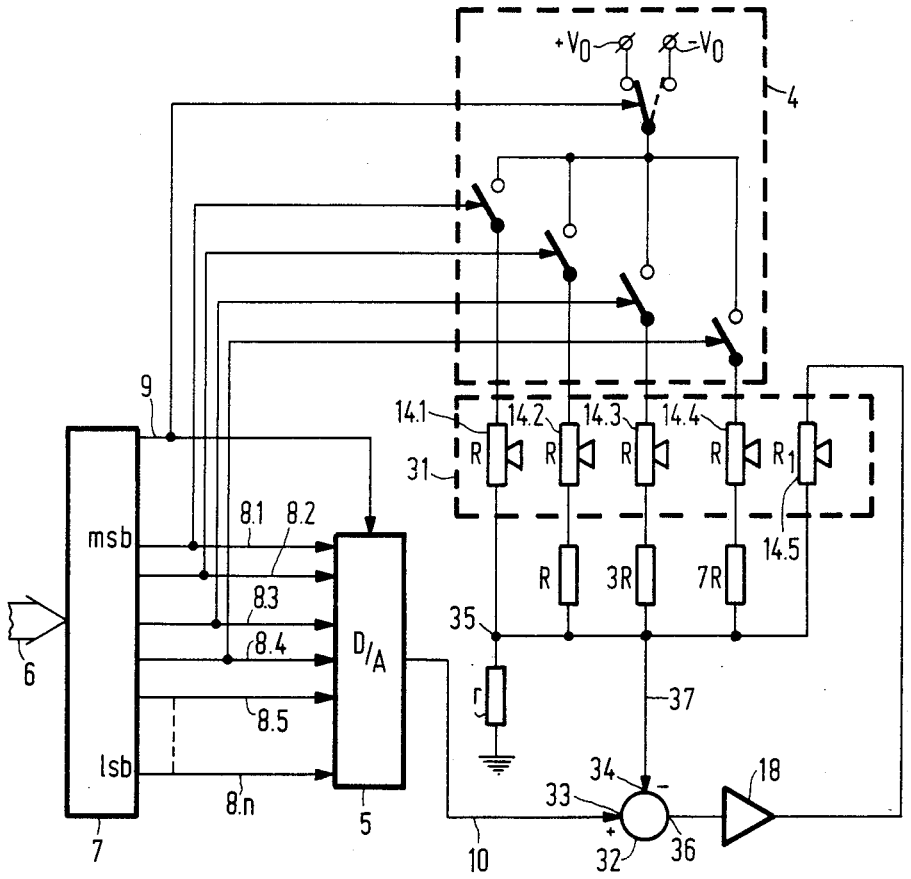

The system comprises means for producing a signal which is a measure of the sum of the instantaneous drive signals of the p (is four) sections corresponding to the p most significant bits and for applying the said signal to a second input 34 of the signal combination unit by the line 37. This means may comprise a measurement resistor arranged in series with each of the voice coils R. The value r of the measurement resistor must comply with $r << R$. The voltages across the measurement resistors may be added to each other and serve as the signal which is applied to the second input 34. Such a version of the means is shown in FIG. 4 which will be described hereinafter. In FIG. 3*a* the means comprise only one measurement resistor r in series with all the voice coils R. The voltage on point 35, i.e. the voltage across the measurement resistor r, is the signal which is applied to the second input 34 of the signal combination unit 32 by the line 37. If no inverting operations are applied elsewhere in the circuit the signal supplied by the line 37 is subtracted from the signal supplied by the line 10 in the signal combination unit 32. The output 36 of the signal combination unit 32 is coupled, if necessary by an amplifier stage 18, to the $(p+1)^{th}$ (i.e. the fifth) section (voice coil) $R_1$ to drive this voice coil. The signal which is applied to the first input 33 of the signal combination unit 32 by the line 10 is a measure of the analog signal corresponding to the complete n-bit digitized electric signal. The signal which is applied to the second input 34 of the signal combination unit 32 by the line 37 is a measure of the analog electric signal corresponding to the (p=) four most significant bits of the digitized electric signal plus the distortion component introduced by the non-exact current or voltage settings in the means for driving the four sections R of the transducer 31. The output signal appearing on the output 36 of the signal-combination unit 32 is applied to the $(p+1)^{th}$ voice coil $R_1$ and is consequently a measure of and provides a correction for the missing signal corresponding to the n−4 least significant bits and for said distortion if the gain setting of the amplifier stage 18 is correct. The distortion in the acoustic output signal of the transducer 31 is thus reduced. However, the circuit has the disadvantage that it is not capable of automatically correcting for time-dependent variations in the current or voltage setting. This would require a continual adaptation of the gain setting of the amplifier stage 18. An improvement of the system shown with FIG. 3*a* can be obtained by connecting the $(p+1)^{th}$ section $R_1$ to point 35 instead of directly to earth. This is shown in FIG. 3*b*. Thus, feedback is applied, enabling automatic compensation for time-dependent variations in the current or voltage setting to be obtained. The requirements imposed on the amplifier stage 18 are now as follows. Since negative feedback is applied, the amplifier stage 18 must be capable of providing a high gain over a wide frequency range. Moreover, the amplifier stage must be fairly accurate, i.e. have a low distortion.

Figure 4A:
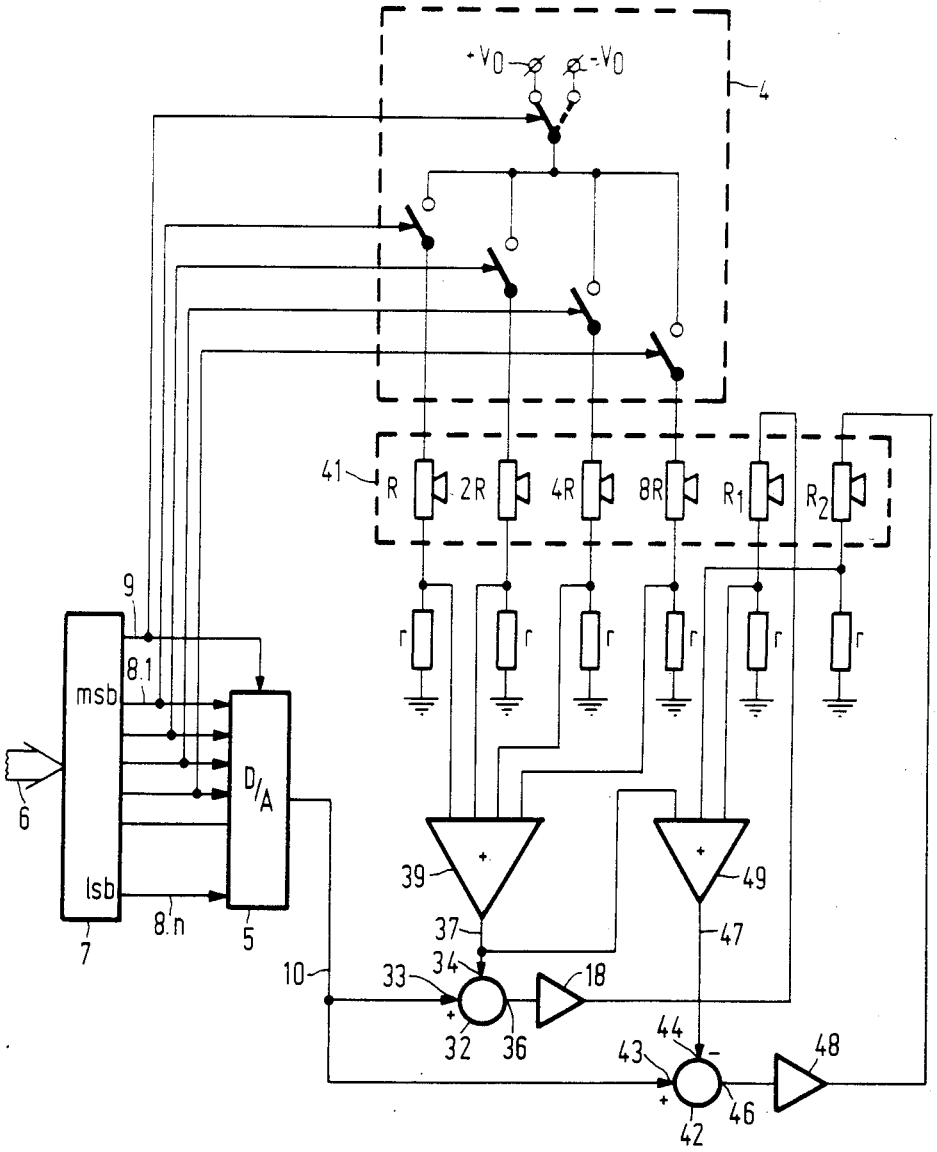

FIG. 4*a* shows another loudspeaker system in accordance with the invention. In addition, the electroacoustic transducer 41 now comprises a $(p+2)^{th}$ or sixth section (voice coil) $R_2$. The output of the digital-to-analog converter 5 is also coupled to a first input 43 of a second signal combination unit 42 by the line 10, the output of the unit being coupled to the sixth voice coil $R_2$ to drive this voice coil, if necessary by a second amplifier stage 48. The first four voice coils bear the references R, 2R, 4R and 8R in conformity with their resistance values.

The means for producing a signal for the four voice coils R, 2R, 4R and 8R now comprise separate measurement resistors r in series with the associated voice coils and the adder 39. The voltages across the resistors r are applied to and added together in the adder 39. The output of the adder 39 is connected to the second input 34 of the signal combination unit 32. Through the line 37, a second adder 49, and the line 47, the output signals of adder 39 is also applied to a second input 44 of the second signal combination unit 42. The fifth and sixth voice coil, $R_1$ and $R_2$ respectively, are also provided with means for producing a signal which is a measure of the instantaneous drive signals of the fifth and sixth section which means comprise a measurement resistor r in series with the associated voice coil and the adder 49. The voltages across the measurement resistors r are also applied to the second input 44 of the second signal combination unit 42 through the adder 49 and the line 47. The system comprises two correction circuits: a first circuit from the output 36 of the signal combination unit 32 to the $(p+1)^{th}$ section $R_1$ through amplifier stage 18—this is feed-forward control based on the "adding what is missing" principle—and a second circuit from the output 46 of the signal combination unit 42 to the $(p+2)^{th}$ section $R_2$ through the amplifier stage 48. This is a feedback circuit. The loudspeaker system shown in FIG. 4*a* has advantages over the loudspeaker system of FIG. 3*b*. This can be illustrated by means of the following calculations.

The signals $V_{37}$ and $V_{47}$ on the lines 37 and 47 in FIGS. 3*b* and 4*a* respectively are measures of the total sum current through all the voice coils and are consequently measures of the acoustic output signals of the transducers 31 and 41 respectively. $V_{10}$ is the output signal of the digital-to-analog converter 5. The signals $V_{37}$-$V_{10}$ and $V_{47}$-$V_{10}$ appearing on the outputs of the signal combination unit 32 in FIG. 3*b* and the signal combination unit 42 in FIG. 4*a* respectively are the correction signals which are applied to the voice coil $R_1$ in FIG. 3*b* and $R_2$ in FIG. 4*a* respectively. These correction signals can be calculated. This yields:

$$V_{37} - V_{10} = \Delta V \cdot \frac{1}{1 + \frac{r}{R_1} A_1} \quad (1)$$

$$V_{47} - V_{10} = \Delta V \cdot \frac{1 - \frac{r}{R_1} A_1}{1 + \frac{r}{R_2} A_2} \quad (2)$$

Here, $A_1$ and $A_2$ are the gain factors of the amplifier stages 18 and 48 respectively, and $\Delta V$ is the difference between the signal ($V_{10}$) from the digital-to-analog converter and the signal generated by the four most significant bits, the output signal of the adder 39.

The correction terms—equations (1) and (2)—must be as small as possible. In the circuit shown in FIG. 3*b*—equation (1)—this can be achieved by making $A_1$ very large. As a result of this the requirements imposed on the amplifier stage 18 in FIG. 3*b* are very stringent. This is because the amplifier stage must then have a high gain factor over a wide frequency range. Moreover, the distortion of the amplifier stage must be minimal. In the circuit shown in FIG. 4*a*—equation (2)—a small correction term can be obtained by selecting the gain factor $A_1$ to equal $R_1/r$. The gain factor $A_1$ of the amplifier stage 18 in FIG. 4*a* may therefore be substantially lower than the gain factor $A_1$ of the amplifier stage 18 in FIG. 3*b*. Also, less stringent requirements have to be imposed on the gain factor $A_2$. The gain factor $A_2$ may be substantially lower than the gain factor $A_1$ of FIG. 3*b*. The amplifier 48 must be capable of reproduction over a large frequency range and must be comparatively accurate, i.e. have a low distortion. As the power to be delivered, amplifier 48 is lower than that to be delivered by the amplifier 18, these requirements can be readily met for the amplifier stage 48.

Figure 4B:
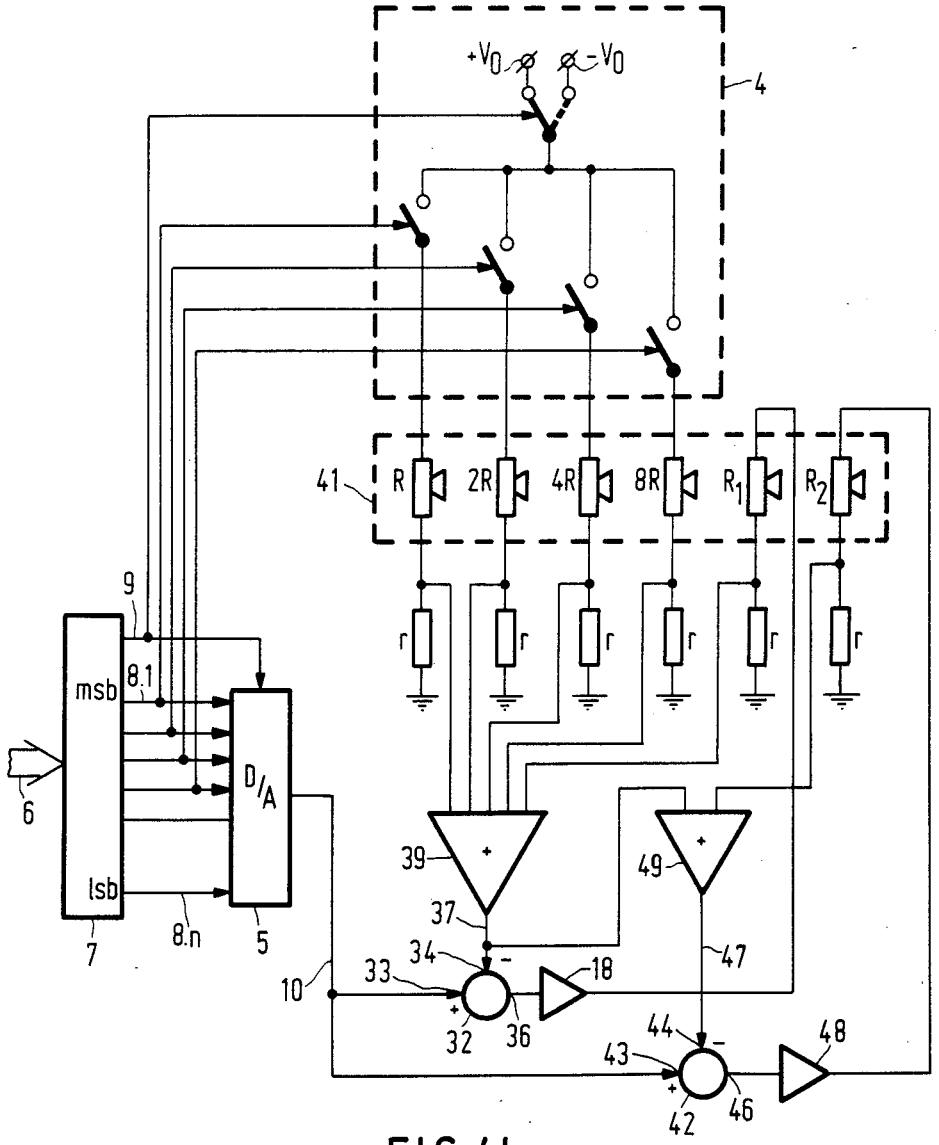

Another loudspeaker system comprising two correction circuits and bearing much resemblance to the system shown in FIG. 4*a* is shown in FIG. 4*b*. The first correction circuit is a negative-feedback circuit from the output 36 of the signal combination unit 32 to the voice coil $R_1$ through the amplifier stage 18. The second correction circuit is also a negative-feedback circuit from the output 46 of the signal combination unit 42 to the voice coil $R_2$ through the amplifier stage 48. The requirements imposed on the amplifier stages 18 and 42 are largely the same as those imposed on the amplifier stages of the circuit shown in FIG. 4*a*.

It is to be noted that the invention is not limited to the loudspeaker systems as described with reference to the Figures. Various modifications are possible to the embodiments described without departing from the scope of the invention as defined by the claims. For example, the invention is also applicable to loudspeaker systems comprising a capacitive electroacoustic transducer, the transducer sections comprising a plurality of electrostatic loudspeakers and the significance of the bits manifesting itself in the electroacoustic conversion in that, for example, the electrostatic loudspeakers which correspond to more significant bits have larger surface areas.

What is claimed is:

1. A loudspeaker system for converting a digital electrical signal of N bits into an acoustic signal comprising:

an electromechanical transducer device for converting an electrical signal into a mechanical quantity for driving a diaphram, said transducer including a plurality of p electrically driven sections, fewer in number than said number N bits of said digital signal, and a p+1 section for receiving an analog voltage;

means for driving each of said p electrical driven sections with one bit from the most significant bits of said electrical signal; and a digital to analog converter for receiving the least significant bits of said digital electric signal, said digital to analog converter connected to said p+1 section of said transducer whereby said transducer receives p digital signals and one analog signal for generating an acoustic signal.

2. A loudspeaker system as claimed in claim 1, wherein the digital-to-analog converter comprises an input for receiving the N-bit digitized electric signal, the output of the digital-to-analog converter is coupled to a first input of a signal combination unit having an output which is coupled to the p+1 section to drive said p+1 section and means being provided for producing a signal which is a measure of the sum of instantaneous drive signals which drive at least the p sections corresponding to the p most significant bits and for applying said signal which is a measure of the sum of the instantaneous drive signals to a second input of the signal combination unit.

3. A loudspeaker system as claimed in claim 2 further comprising means for producing a signal which is a measure of the sum of instantaneous drive signals applied to the p+1 sections, said instantaneous drive signals corresponding to the p+1 most significant bits of said digital signal and for applying said signal which is a measure of said sum to the second input of the signal combination unit.

4. A loudspeaker system as claimed in claim 2, wherein the output of the digital-to-analog converter is coupled to a first input of a second signal combination unit having an output which is coupled to a p+2 section, said means for producing a signal associated with the p sections supply said signal also to a second input of the second signal combination unit, and the p+1 and p+2 sections are further provided with means for producing a signal which is a measure of the sum of the instantaneous drive signals of at least the p+1 and p+2 sections and for applying said signal to the second input of the second signal combination unit.

5. A loudspeaker system as claimed in claim 3, wherein the output of the digital-to-analog converter is coupled to a first input of a second signal combination unit having an output which is coupled to a p+2 section to drive this section said means for producing a signal associated with the p+1 sections supply said signal also to a second input of the second signal combination unit, and the p+2 section is provided with means for producing a signal which is a measure of the instantaneous drive signal of the p+2 section and for applying said signal to the second input of the second signal combination unit.

6. A loudspeaker system for converting an N bit digitized electric signal into an acoustic signal comprising:

an electroacoustic transducer for converting an electrical signal into an acoustic wave, said transducers having a plurality of sections p less than the number of digits N, and having at least one additional section p+1;

means for driving each of said sections of said plurality of p sections with one bit of said digitized electrical signal;

means for converting a portion of said N bits of said digitized electric signal into an analog voltage;

first means for combining currents from said plurality of p transducer sections produced in response to digital signal bits applied to said plurality of p sections and providing a voltage proportional to said combined currents; and a junction for subtracting said voltage proportional to said combined currents from said analog voltage, said junction providing a signal to said additional section p+1 whereby an acoustic output signal is produced.

7. The loudspeaker system of claim 6 wherein said transducer includes an additional p+2 section further including:

a second means for combining currents produced from said p+1 and p+2 section with a current from said first means for combining currents from said plurality of p transducer sections; and a second junction for subtractively combining said analog voltage with a voltage produced by said second means for combining currents, and applying a resulting voltage to said p+2 section of said transducer.

8. The loudspeaker system of claim 7 wherein said transducer includes an additional p+2 section, further including:

a second means for combining currents produced from said p+2 section with a current produced by said first means for combining; and a second junction for subtractively combining said analog voltage with a voltage produced by said second means for combining and applying a resulting voltage to said p+2 section of said transducer.

* * * * *